US006216756B1

(12) United States Patent
Mason

(10) Patent No.: US 6,216,756 B1
(45) Date of Patent: Apr. 17, 2001

(54) LOG PROCESSING APPARATUS

(76) Inventor: Howard Carl Mason, 892 Oregon Way, Woodburn, OR (US) 97071

( * ) Notice: Subject to any disclaimer, the term of this patent is extended or adjusted under 35 U.S.C. 154(b) by 0 days.

(21) Appl. No.: 09/273,698

(22) Filed: Mar. 22, 1999

(51) Int. Cl.[7] ..... B27C 5/02

(52) U.S. Cl. ..... 144/248.5; 144/246.2; 144/248.4; 144/379; 198/624; 198/592; 198/626.6; 83/436.3; 83/490

(58) Field of Search ..... 83/155, 436.3, 83/436.45, 486.6; 144/242.1, 246.1, 248.4, 248.5, 248.6, 248.7, 250.26, 379, 246.2; 198/604, 624, 626.6, 592

(56) References Cited

U.S. PATENT DOCUMENTS

| | | | | |
|---|---|---|---|---|
| 475,628 | * | 5/1892 | Stombs | 144/248.7 |
| 2,402,849 | | 6/1946 | Sensenig . | |
| 2,410,887 | | 11/1946 | Locke . | |
| 2,625,185 | * | 1/1953 | Merry | 144/246.1 |
| 2,694,425 | | 11/1954 | Skoglund . | |
| 3,068,918 | | 12/1962 | Smith . | |
| 3,371,770 | * | 3/1968 | Graham et al. | 198/624 |
| 3,386,564 | | 6/1968 | Pease . | |
| 3,457,974 | * | 7/1969 | Mitten | 144/246.1 |
| 3,670,609 | | 6/1972 | Contaldo et al. . | |
| 3,709,269 | * | 1/1973 | Cervenak | 144/246.2 |
| 3,844,399 | * | 10/1974 | Sellers, Jr. et al. | 144/248.5 |
| 3,994,327 | * | 11/1976 | Bergholm et al. | 144/248.5 |
| 4,031,788 | | 6/1977 | Boge et al. . | |
| 4,163,406 | | 8/1979 | Crawford . | |
| 4,510,981 | * | 4/1985 | Biller | 144/246.2 |
| 4,823,851 | * | 4/1989 | Seffens | 144/248.4 |
| 4,834,156 | | 5/1989 | Forslund . | |
| 5,167,177 | | 12/1992 | Cimperman et al. . | |
| 5,201,259 | | 4/1993 | Covert et al. . | |
| 5,447,186 | * | 9/1995 | Archard et al. | 144/246.1 |

* cited by examiner

*Primary Examiner*—W. Donald Bray
(74) *Attorney, Agent, or Firm*—Kolisch Hartwell Dickinson McCormack & Heuser

(57) ABSTRACT

A log processing apparatus is disclosed for processing a log with tapered sides, the log processing apparatus including a frame assembly, and infeed guide assembly including upstream and downstream pairs of guides configured to grip and center the tapered log along a travel path. The log processing apparatus may also include a saw assembly positioned adjacent the guides and configured to cut the tapered log in a cutting plane perpendicular to the travel path.

21 Claims, 8 Drawing Sheets

LOG PROCESSING APPARATUS

TECHNICAL FIELD

This invention generally relates to processing logs, and more specifically to a log processing apparatus for centering and processing a log tapered sides.

BACKGROUND OF THE INVENTION

Multiple processes turn logs into finished wood products for consumers. One important process involves using a log saw to cut a large log into smaller sections of predetermined lengths for ease of handling and further processing. Log saws may be stationed at a variety of locations in a mill. When used in a veneer mill, log saws typically are stationed after a debarking machine, which takes the bark off of a log, and before a veneer lathe, which peels a long veneer strip from the log.

To minimize waste, is important that the log saw cut the log in a cutting plane perpendicular to a central longitudinal axis of the log. If the log saw cuts the log in a cutting plane that is askew relative to the central longitudinal axis of the log, the log typically will is have to be squared off by a separate machine before further processing, thereby consuming unneeded time and energy and wasting valuable wood product material.

In a veneer mill, typically the veneer lathe will square the log off with a pair of facing tools positioned near each end of the log. These facing tools typically cause pitting in the ends of the log as they cut across softer and harder regions of the end g of the log. As the veneer lathe peels a sheet of veneer from the log section, the pitted ends of the log will translate into pitted sides on the veneer sheet.

Often, logs fed to a log saw for sectioning will be tapered in shape, with a wide base, a narrow top, and tapered sides extending therebetween One problem with cent log saws is that they typically are unable to center a tapered log such that the log saw may be cut in a cutting plane perpendicular to the central longitudinal axis of the log. Log saws equipped with horizontal planes of su t normally will hold a tapered log such that the central longitudinal axis of the tapered log extends at a slight incline relative to the plane. In this case, a saw blade that is perpendicular to the plane of support Will cut the log in a cutting plane that is inclined to the central longitudinal axis of the log, thereby necessitating that the tapered log be squared off by a separate machine, as described above.

Certain log saws have been designed with an inclined conveyor for moving a tapered log into a cutting station such that the central longitudinal axis of the tapered log is normal to the plane of cutting. However, these devices generally are cumbersome, slow in operation, and designed to handle logs of similar size that are oriented with their tapers extending in the same direction.

In addition, a log saw is most efficient when it is capable of analyzing a log, and applying a predetermined formula to determine the optimum number and length of sections to cut from the log Current log sawing systems utilize a three dimensional scanner and associated computer software to determine optimum section lengths. A saw operator reads the section lengths, adjusts a mechanical stopper to the specified distance, then feeds the log through the saw until an end of the log rams the stopper. The operator cuts the log and readjusts the stopper to repeat the cycle.

This process is arduous on the operator and the machinery. Great impact forces are produced as the logs ram against the stop, necessitating the use of ear protection by the operator, and causing wear on the machine. In addition, operator error may cause the stopper to be placed out of position, and the log to be miscut.

In addition, a log saw is most efficient when the cycle time of the saw blade during each cut is minimized. Cycle time for a cut primary is affected by movement of the log and movement of the saw blade. Current log saws typically accelerate a log from a full stop, move the log into the machine, and bring the log back to a full stop in position for cutting. When attempting to operate a log saw at high speeds, bringing the heavy log to a complete stop takes valuable time and energy. In addition, time typically also is wasted on each cut cycle while waiting for the log to bounce repeatedly against the stop before coming to a rest.

Current saw blades often require the saw blade to travel the same distance on each cut regardless of the diameter of the log being cut, wasting time and energy when cutting logs of smaller diameter. This is because current log saws typically position both small and large logs such that the bottom of the log rests near the bottom of the circular saw blade when the log is being cut. In such a configuration, moving the saw blade from a retracted position to an extended position where the bottom of the saw blade cuts completely through the bottom of the log requires the saw blade to travel a distance significantly greater than the diameter of smaller logs.

SUMMARY OF THE INVENTION

A log processing apparatus is provided for processing a tapered log, where the tapered log has a central axis, and a region of larger diameter and region of smaller diameter. Typically the log processing apparatus includes a frame assembly and a roller assembly. The roller assembly typically includes a pair of upstream rollers coupled to the frame assembly by a pair of upstream roller mounts, and a pair of downstream rollers coupled to the frame assembly by a pair of downstream roller mounts. Each of the upstream and downstream rollers typically are positioned on opposing sides of a travel path of the tapered log, each roller including a contact region and an axis of rotation, the contact region of each roller being configured to clamp against an opposing side of the tapered log and guide the tapered log along the travel path. Each of the pair of upstream and downstream roller mounts typically are configured to support and adjust the axes of rotation of a pair of respective rollers toward and away from the travel path in tandem such that the contact region of each roller remains substantially equidistant from the travel path of the log. Typically, the pair of upstream rollers and the pair of downstream rollers are configured to adjust independently of each other and clamp the tapered log in respective regions of larger and smaller diameter, thereby supporting the tapered log such that the central axis of the tapered log remains substantially aligned with the travel path. The log processing apparatus may also include a saw assembly positioned adjacent the roller assembly, the saw assembly including a saw blade configured to cut the tapered log along a cutting plane substantially perpendicular to the central axis of the tapered log.

The advantages of the present invention will be understood more readily after a consideration of the drawings and the Detailed Description of the Preferred Embodiment.

DETAILED DESCRIPTION OF THE PREFERRED EMBODIMENT

Figure 1:
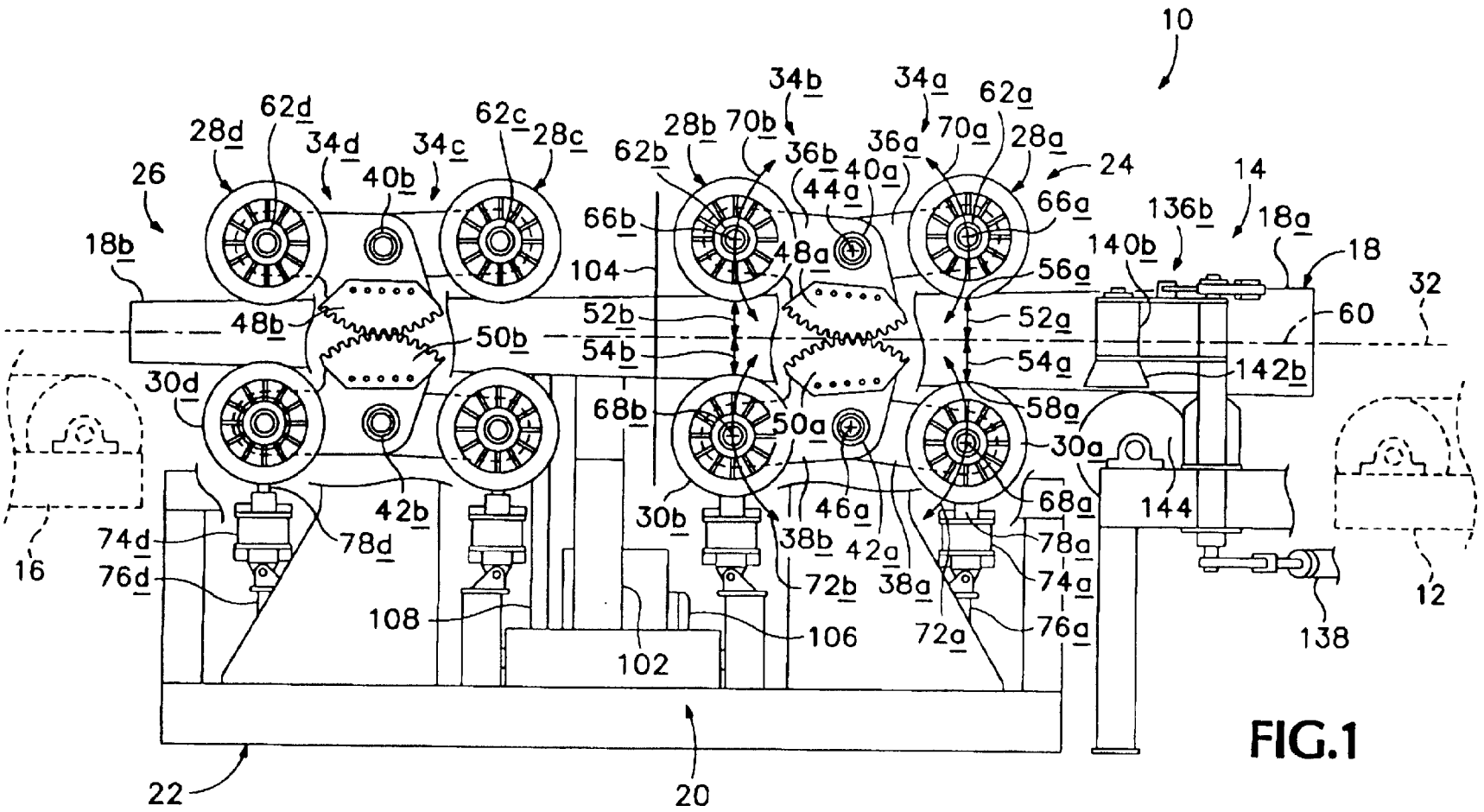
FIG. 1 is a side view showing a log processing apparatus constructed in accordance with the present invention.

Referring initially to FIG. 1, log processing apparatus 10 typically is configured to operate between an infeed conveyor 12 equipped with a horizontal centering device 14, and an outfeed conveyor 16. The log processing apparatus is configured to receive a log 18 from the infeed conveyor through the horizontal centering device, process the log with a tool, such as saw assembly 20, and pass the log to outfeed conveyor 16. The tool, it will be appreciated, may be virtually any kind of tool, including a drill, sander, lathe, debarker, stainer, etc., but herein is described as a saw assembly. Where a saw is used, log processing apparatus 10 alternatively may be referred to as log saw 10.

Log processing apparatus 10 includes a frame assembly 22 configured to support an infeed guide or roller assembly 24. Infeed guide assembly 24 is configured to guide log 18 from infeed conveyor 12 through horizontal centering device 14 and into the log processing apparatus.

Figure 10A:
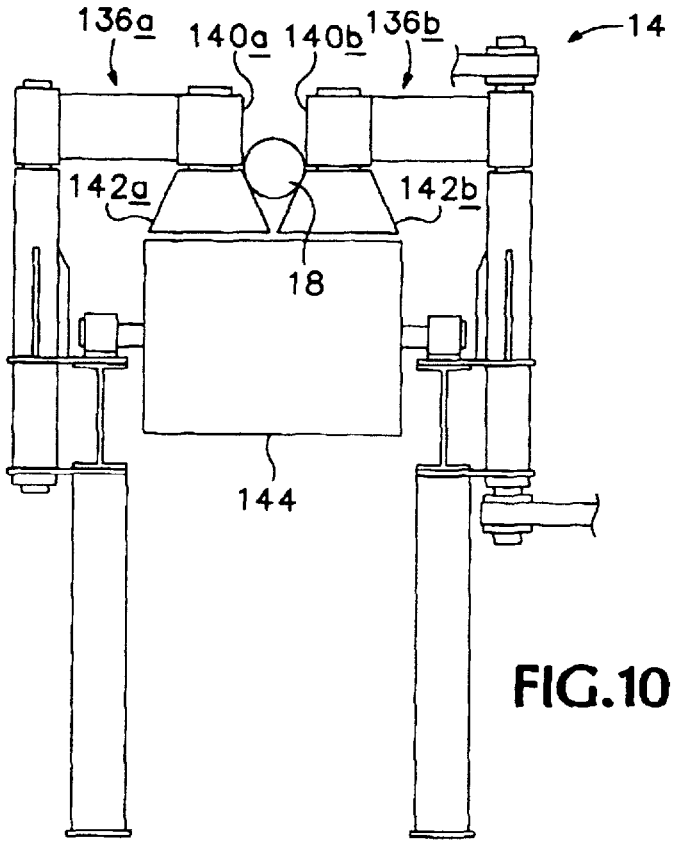
FIG. 10A is a view of a horizontal centering device in a closed configuration, guiding a small log.
Figure 10B:
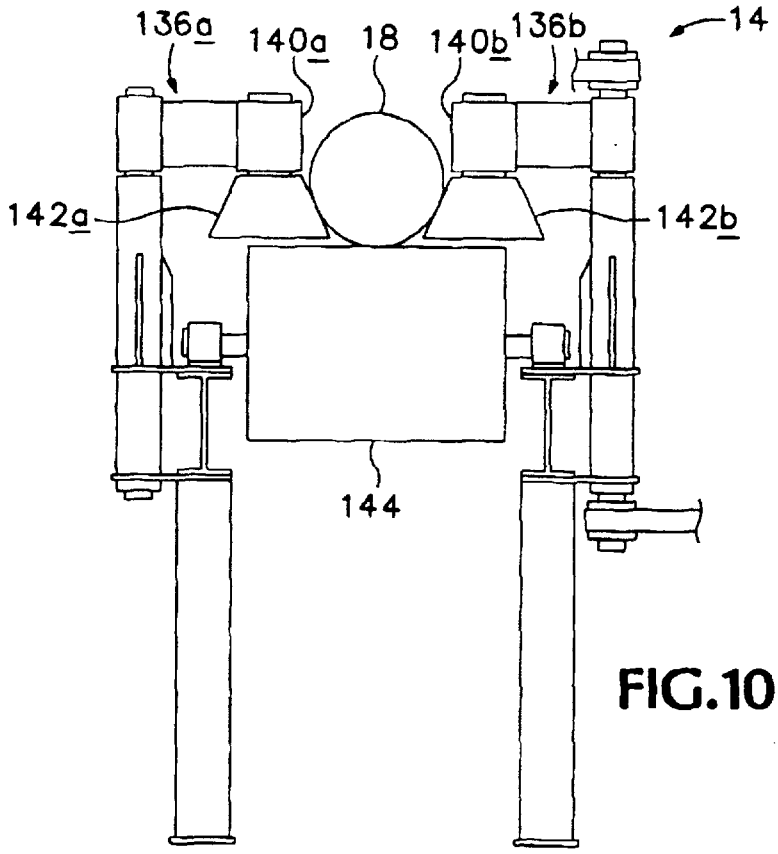
FIG. 10B is a view of the horizontal centering device of FIG. 10A in an open configuration, guiding a large log.

As shown in FIGS. 10A and 10B, log 18 is centered horizontally by arms 136*a* 136*b* which are biased against the log by piston 138 and linkage 137 as the log passes through the horizontal centering device. Rollers 140 include sloped sections 142 that are configured to lift the log from wheel 144 and vertically center the log before it passes into the infeed guide assembly.

Typically, log processing apparatus 10 also includes an outfeed guide or roller assembly 26 mounted to the frame assembly in spaced-apart relation to infeed guide assembly 24. Outfeed guide assembly 26 is configured to guide the tapered log from the log processing apparatus to outfeed conveyor 16.

Infeed guide assembly 24 typically includes a pair of upstream guides or rollers 28*a*, 30*a* positioned on opposing sides of a travel path 32. Upstream guides 28*a*, 30*a* are biased toward travel path 32 by an upstream clamping mechanism 34*a*. Typically, clamping mechanism 34*a* includes a pair of upstream guide or roller mounts 36*a*, 38*a* pivotably mounted to a respective one of main shafts 40*a* and 42*a*, and being configured to rotate about a respective axis 44*a* and 46*a*. Upstream guide mounts 36*a*, 38*a* include respective intermeshing gear regions 48*a*, 50*a* which enable mounts 36*a*. 38*a* to pivot in tandem an equal distance from travel path 32 and in opposite directions from each other about respective main shafts 40*a* and 42*a*. Intermeshing gear regions 48*a* and 50*a* are configured to pivot guides 28*a* and 30*a* such that the distances 52*a* and 54*a* between respective contact regions 56*a* and 58*a* of guides 28*a* and 30*a* and travel path 32 remain substantially equal in magnitude, thereby centering a central longitudinal axis 60 of log 18 between the contact regions and along travel path 32.

A distal end of each of upstream guide mounts 36*a* and 38*a* is configured to support a respective axle 62*a* or 64*a*. Each of guides 28*a* and 30*a* is mounted rotatably to a respective one of axles 62 or 64*a* and configured to rotate about a respective axis of rotation 66*a* or 68*a*. As upstream guide mounts 36*a* and 38*a* pivot in tandem toward and away from travel path 32, axles 62*a* and 64*a* and axes of rotation 66*a* and 68*a* are moved along clamping paths 70*a* and 72*a*.

Typically, air cylinder 74*a* is pivotably attached to frame assembly 22 at a lower end by air cylinder support 76*a*. Air cylinder 74*a* includes a piston 78*a* pivotably mounted to a lower one of the upstream guide mounts. The piston is configured to selectively extend from and retract into air cylinder 74*a* thereby causing the lower upstream guide mount 38*a* to rotate about lower main shaft 42*a*.

As lower upstream guide mount 38*a* is rotated, intermeshing of gear regions 48*a* and 50*a* in turn causes the upper upstream guide mount 36*a* to pivot in tandem with the lower upstream guide mount 38*a* about main shafts 40*a* and 42*a*. By applying pressure to air cylinder 74*a* and extending piston 781 clamping mechanism 34*a* is able to clamp log 18 such that the central longitudinal axis 60 of log 18 is centered along travel path 32 between guides 28*a* and 30*a*.

Infeed guide assembly 24 also may include a pair of downstream guides or rollers 28*b* and 30*b* positioned on opposing sides of the travel path 32. Downstream guides 28*b* and 30*b* are biased toward travel path 32 by a downstream clamping mechanism 34*b*. Typically, clamping mechanism 34*b* includes a pair of downstream guide or roller mounts 36*b* and 38*b* pivotably mounted to a respective one of main shafts 40*a* and 42, and being configured to rotate about a respective axis 44*a* or 46*a*. Downstream guide mounts 36*b* and 38*b* include respective intermeshing gear regions 48*b* and 50*b*, which enable mounts 36*b* and 38*b* to pivot in tandem an equal distance from travel path 32 and in opposite directions from each other about respective main shafts 40*a*, 42*a*. Intermeshing gear regions 48*b* and 50*b* are configured to pivot guides 28*b* and 30*b* such that the distances 52*b* and 54*b* between respective contact regions 56*b* and 58*b* of guides 28*b* and 30*b* remain substantially equal in magnitude, thereby substantially centering a central longitudinal axis 60 of log 18 between the contact regions along travel path 32.

A distal end of each of downstream guide mounts 36*b* and 38*b* is configured to support a respective axle 62*b* or 64*b*. Each of guides 28*b* and 32*b* is rotatably mounted to a respective one of axles 62*b* or 64*b* and configured to rotate about a respective axis of rotation 66*b* and 68*b*. As upstream guide mounts 36*b* and 38*b* pivot in tandem toward and away from travel path 32, axles 62*b* and 64*b* and axes of rotation 66*b* and 68*b* are moved along clamping paths 70*b* and 72*b*.

Typically, air cylinder 74*b* is rotatably attached to frame assembly 22 at a lower end by air cylinder support 76*b*. Air cylinder 74*b* includes a piston 78*b* pivotably mounted to a lower one of the downstream guide mounts. The piston is configured to selectively extend from and retract into air cylinder 74*b*, thereby causing the lower downstream guide mount 38*b* to rotate about lower main shaft 42.

As lower downstream guide mount 38*b* is rotated, intermeshing of gear regions 48*b* and 50*b* in turn causes the upper downstream guide mount 36*b* to pivot in tandem with the lower downstream guide mount 38*b* about main shafts 40*b* and 42*b*. By applying pressure to air cylinder 74*b* and extending piston 78*b*, clamping mechanism 34*b* is able to clamp log 18 such that the central longitudinal axis 60 of log 18 is centered along travel path 32 between guides 28*b* and 30*b*.

The pair of upstream guides 28*a* and 30*a* and the pair of downstream guides 28*b* and 30*b* are configured cooperatively to clamp tapered log 18 in respective regions of larger and smaller diameter when each of the air cylinders 74*a* and 74*b* are pressurized and biasing clamping mechanisms 34*a* and 34*b* inward, thereby aligning the central axis 60 of the tapered log substantially along the travel path 32. Where the central axis 60 is irregularly shaped, central axis 60 may diverge from travel path 32 in certain regions, however clamping mechanisms 34*a* and 34*b* act to substantially center log 18 between contact regions 56*a* and 58*a*, and 56*b* and 58*b* of guides 28*a* and 30*a* and 28*b* and 30*b*, respectively.

Figure 2:
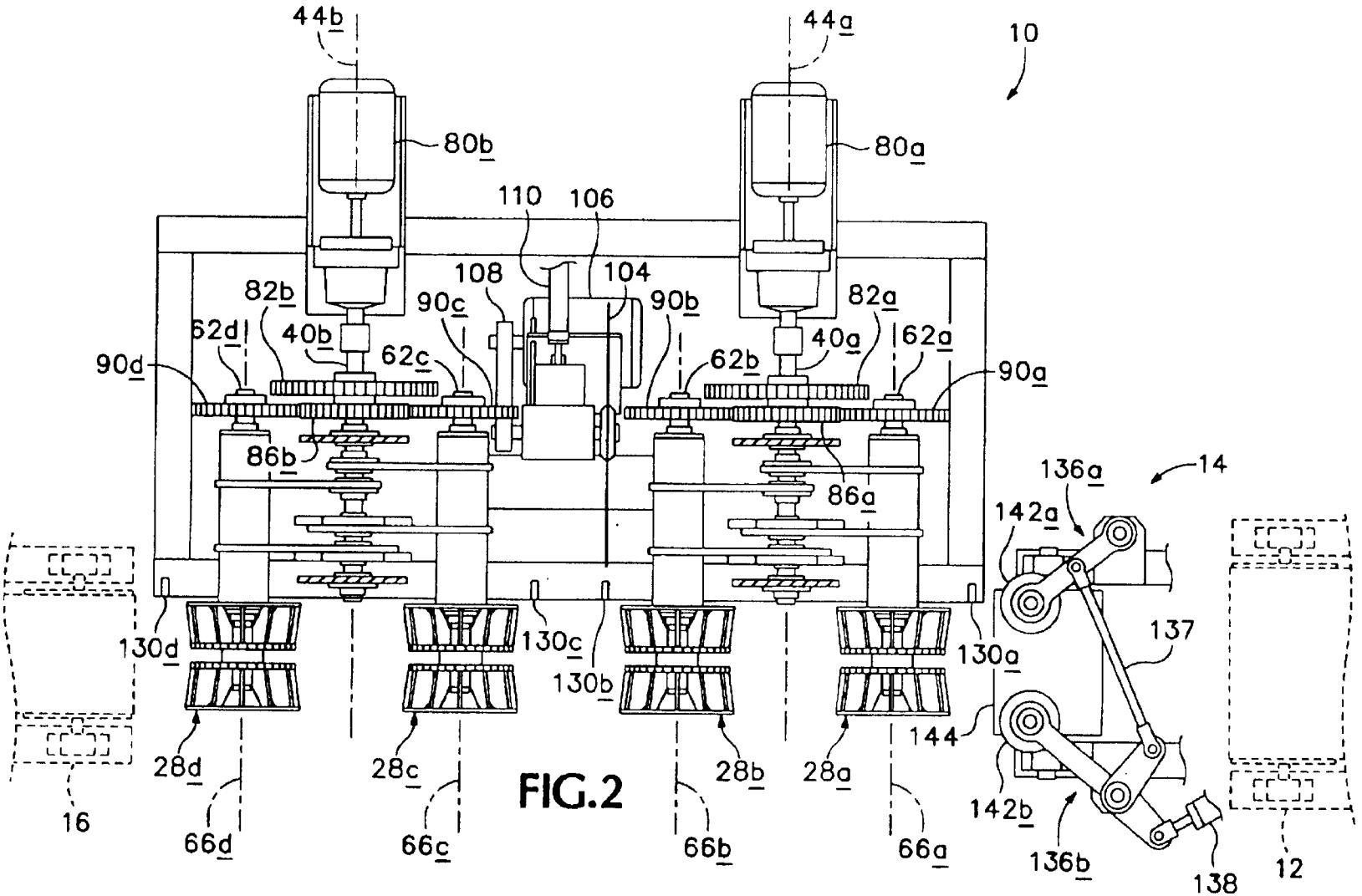
FIG. 2 is a top view of the log processing apparatus.
Figure 4:
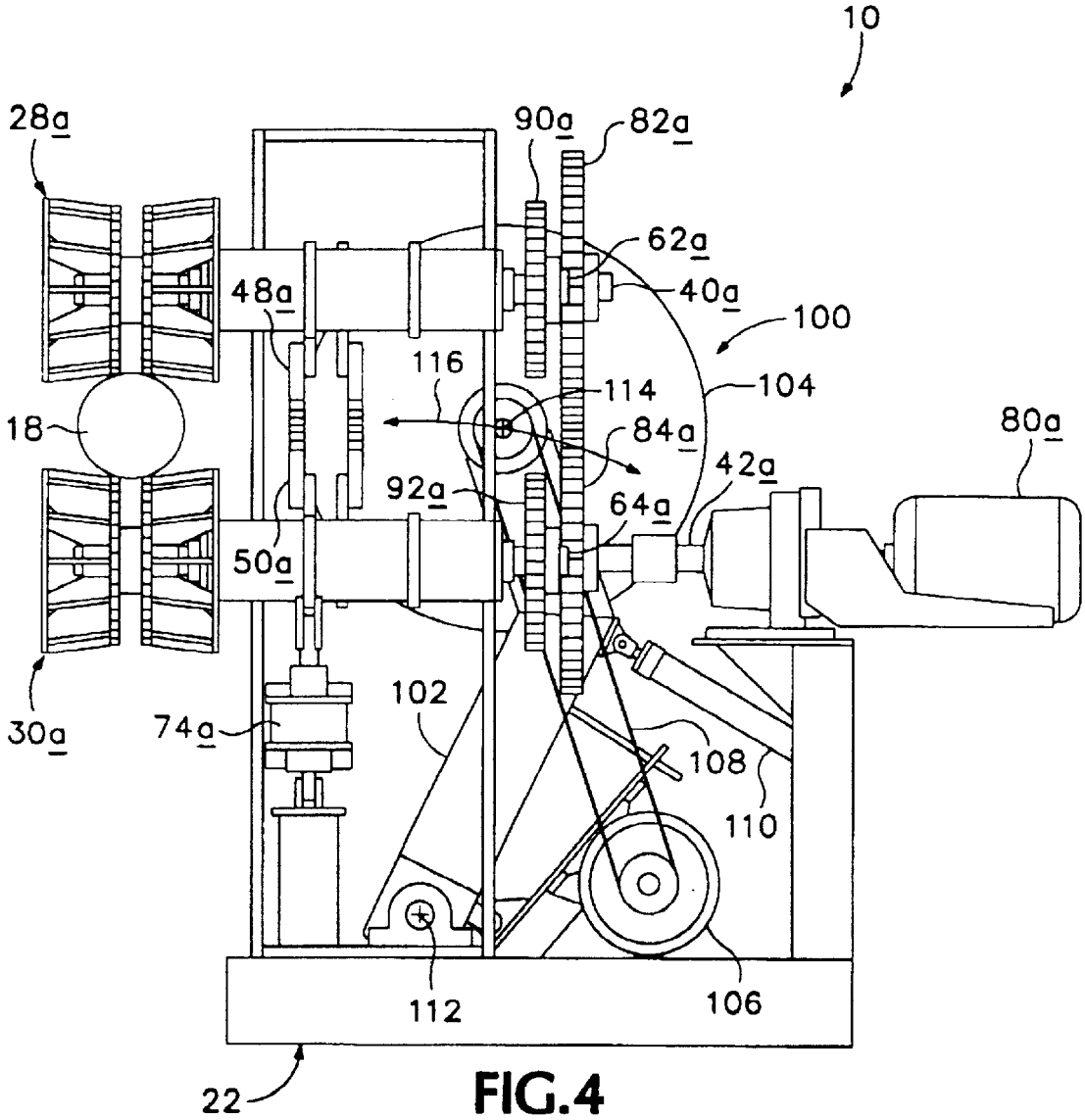
FIG. 4 is a cutaway side view showing a saw assembly of the log processing apparatus in a retracted position.

As shown in FIG. 2, infeed guide assembly 24 also may include a motor 80*a* drivingly coupled to upper main shaft 40*a*. As shown in FIG. 4, upper main gear 82*a* is mounted to upper main shaft 40*a* and lower main gear 84*a* is mounted to lower main shaft 42*a*. Main gears 82*a*, 84*a* are configured to mesh and transfer power from upper main shaft 40*a* to lower main shaft 42*a*.

Figure 5:
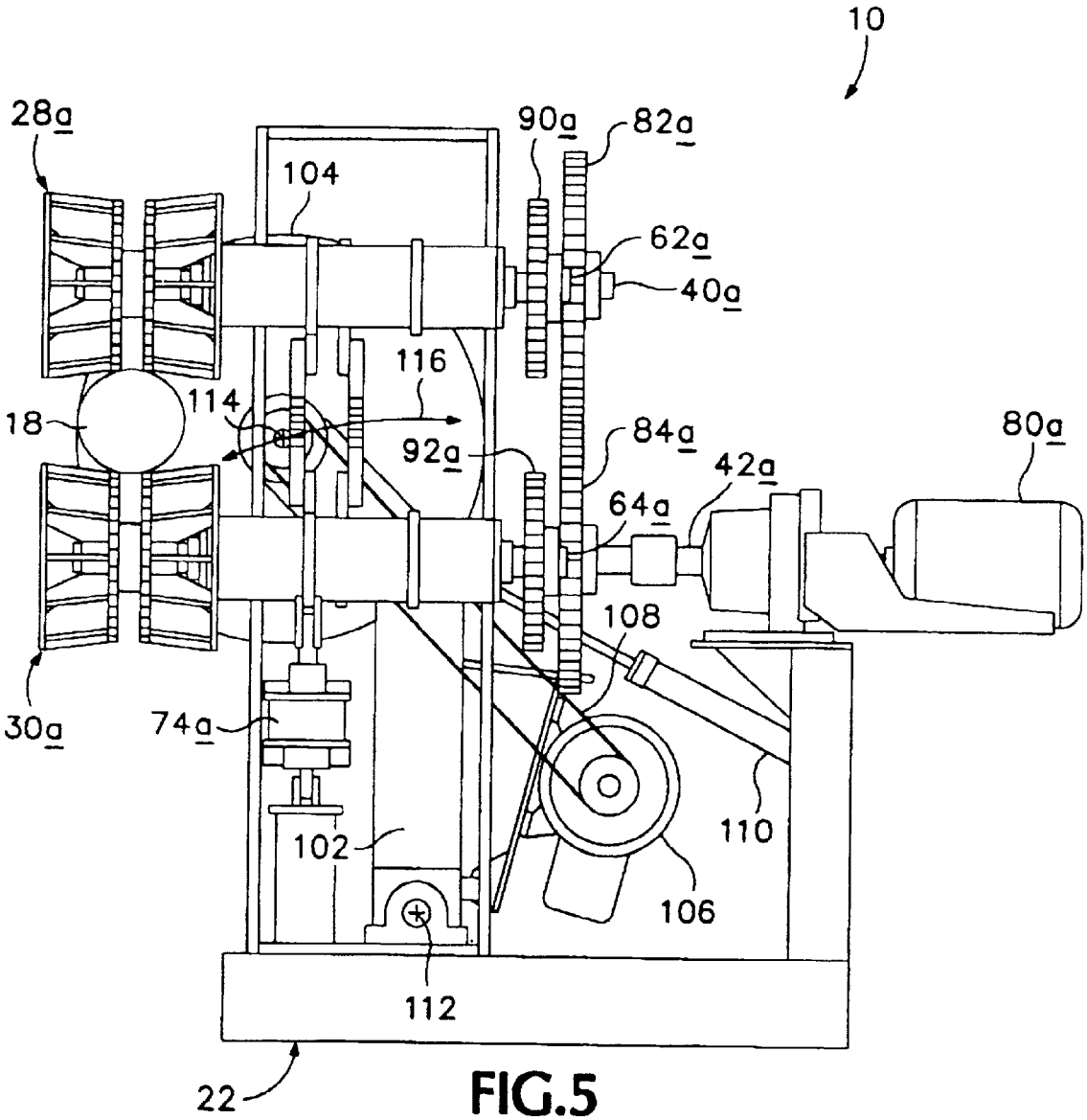
FIG. 5 is a cutaway side view of the saw assembly of FIG. 3 in an extended position.

An upper center drive gear 86*a* is coupled to upper main shaft 40*a* and a lower center drive gear (not shown) is coupled to lower main shaft 46*a*. As shown in FIGS. 2, 4, and 5, the center drive gears are configured to intermesh with and transfer power to a respective pair of peripheral drive gears, such as 90*a* and 90*b*, or 92*a* and a counterpart drive gear (not shown). Drive gears 90*a* and 90*b* are mounted to axles 62*a* and 62*b*, respectively, and are configured to cause guides 28*a* and 28*b*, respectively, to rotate. Drive gear 92*a* and a counterpart (not shown) are mounted to axles 64*a* and 64*b*, respectively, and are configured to cause guides 30*a* and 30*b*, respectively, to rotate. As clamping mechanisms 34*a* and 34*b* move axles 62*a*, 62*b*, and 64*a*, 64*b* along clamping paths 70*a* 70*b*, 72*a*, 72*b*, respectively, center drive gears 86*a*, 88*a* are configured to remain in constant driving contact with the peripheral drive gears 90*a* and 90*b*, and 92*a* a counterpart (not shown), respectively.

Log processing apparatus 10 also may include outfeed guide assembly 26. Typically, outfeed guide assembly 26 is substantially similar in componentry and construction to infeed guide assembly 24. Like parts in the infeed and outfeed guide assemblies are labeled with identical numerals, but with different letter indicators. For example, 28*a* and 28*b* respectively indicate the upper upstream and downstream guides on the infeed guide assembly, whereas 28*c* and 28*d* respectively indicate the upper upstream and downstream guides on the outfeed guide assembly. Outfeed guide assembly 26, in conjunction with infeed guide assembly 24, enables the log processing apparatus 10 to grip independently each of an upstream section 18*a* and a downstream section 18*b* of log 18, after log 18 is cut.

Referring now to FIGS. 4 and 5, a saw assembly is shown generally at 100, including a saw support structure 102 pivotably attached to frame assembly 22. Saw support structure 102 is configured to support saw blade 104 and saw motor 106. Saw motor 106 is configured to drive saw blade 104 via belt 108. Piston 110 is attached at one end to frame assembly 22 and at a second end to saw support structure 102, and is configured to extend and cause saw support structure 102 to pivot about pivot axis 112. As saw support structure 102 pivots relative to frame assembly 22 about pivot axis 112, so do saw blade 104 and saw motor 106, and belt 108.

Saw blade 104 is configured to rotate about an axis of rotation 114 and cut tapered log 18 as saw support structure 102 is pivoted toward the tapered log. Axis of rotation 114 typically moves along cutting path 116 as saw support structure 102 rotates the saw blade into the tapered log, such that the saw blade cuts the tapered log along a cutting plane substantially perpendicular to the central axis of the tapered log. Because the infeed and outfeed guide assemblies substantially center the log vertically with respect to the saw blade, the blade is able to cut completely through the log upon traveling less than half the diameter of the saw blade in the horizontal direction. In addition, where horizontal centering device 14 is configured to sense the width of the log, the saw blade support structure may be configured to rotate the saw blade only a minimum distance necessary to saw through the log, thereby minimizing motion of the saw blade and shortening the cut cycle time for logs of smaller diameter.

Figure 3:
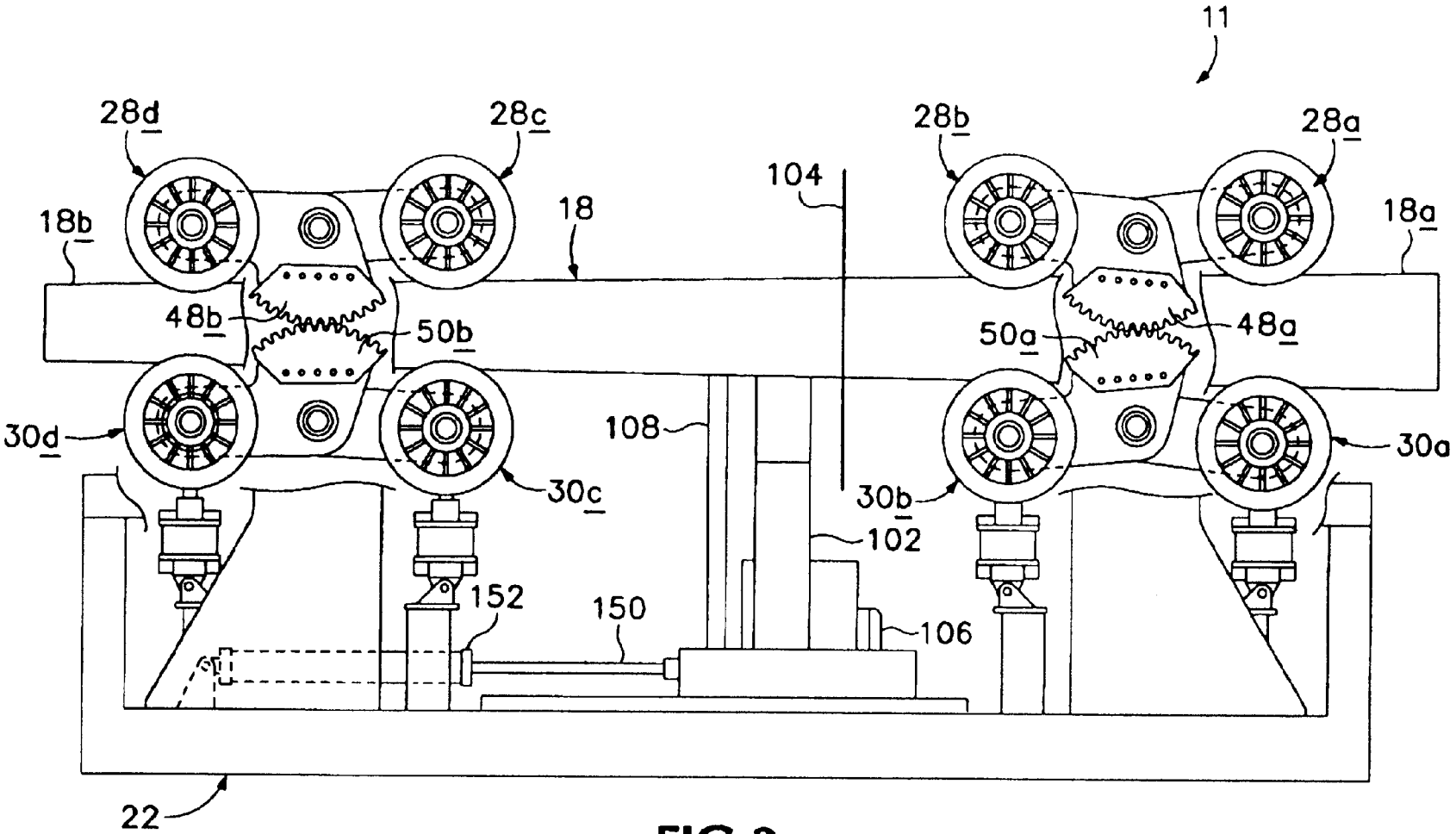
FIG. 3 is a side view of another embodiment of the log processing apparatus.

FIG. 3 shows another embodiment 11 of the log processing apparatus, where saw support structure 102 is mounted to track 150 and piston 152. Piston 152 is configured to move saw support structure 102 and saw blade 104 along track 150 at a rate of speed substantially equal to the rate of speed of the log moving along the travel path. In this embodiment, saw assembly 20 is configured to cut log 18 while the log is moving. Because the log does not have to be slowed to a complete stop to be cut, cycle time per cut is reduced.

Figure 6:
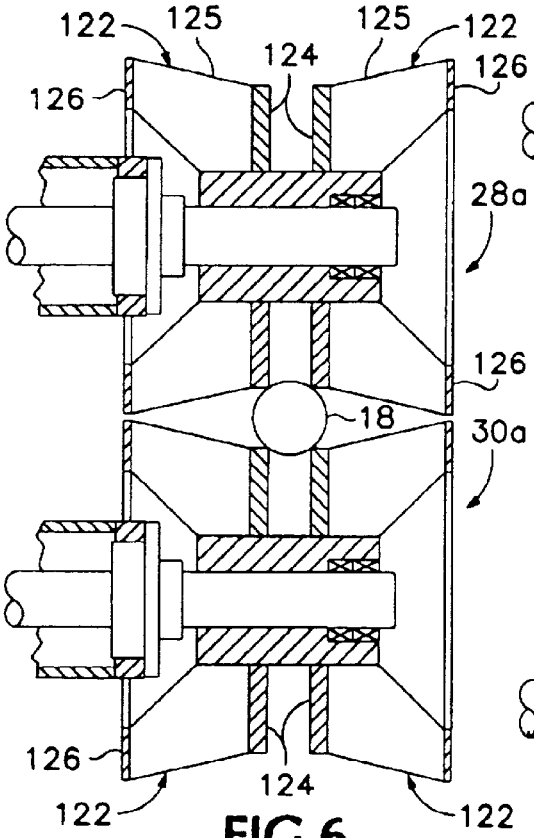
FIG. 6 is a detail side view of a pair of rollers of the log processing apparatus, in a pressed-together configuration holding a small diameter log.
Figure 7:
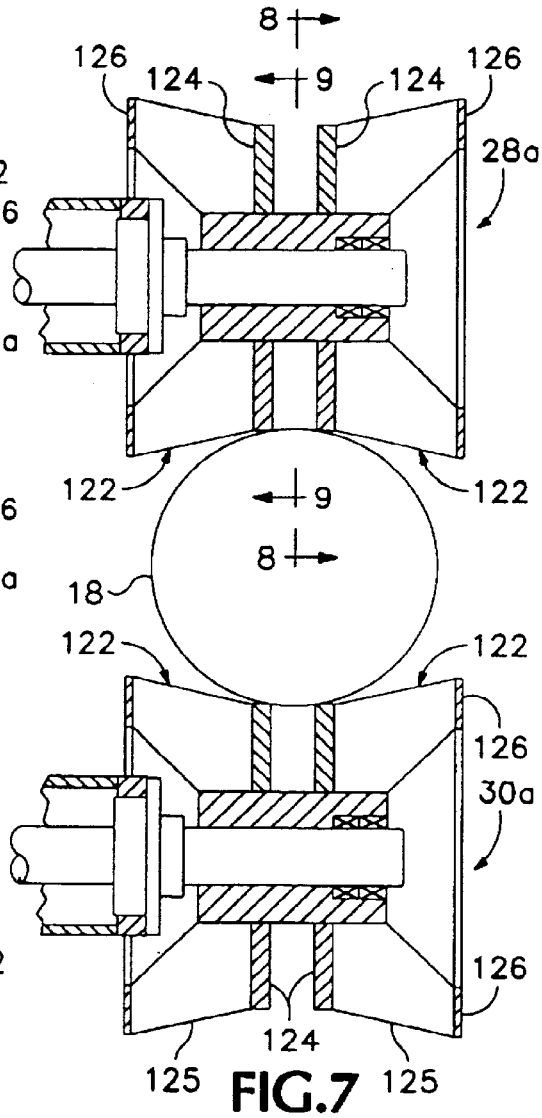
FIG. 7 is a detail side view of a pair of rollers of the log processing ape in a spaced-apart configuration holding a large diameter log.
Figure 8:
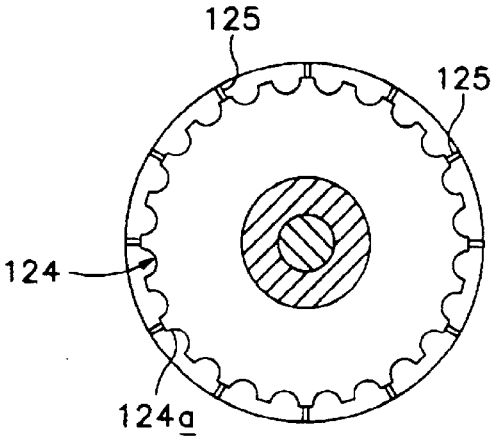
FIG. 8 is a cross-sectional view of the roller shown in FIG. 7, showing in detail a right-hand sheave of the roller.
Figure 9:
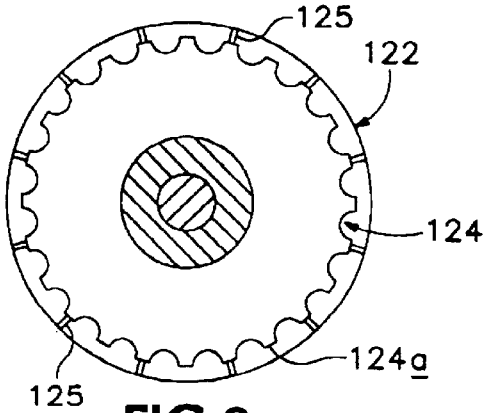
FIG. 9 is a cross-sectional view of the roller shown in FIG. 7, showing in detail a left-hand sheave of the roller.

Referring now to FIGS. 6, 7, 8, and 9, guides or rollers 28*a*, 30*a* include a pair of inwardly sloping disks or sheaves 122 configured to center laterally a log within the roller or guide. A toothed wheel 124 is positioned adjacent an inward side of each inwardly sloping disk 122. Toothed wheel 124 includes teeth 124*a*, and is configured to rollingly engage tapered log 18. Inwardly sloping disks 122 may further include fins 125. Preferably, fins 125 do not touch log 18 as it is clamped by the rollers. Alternatively, fins 125 are configured to center and/or rollingly engage the log as it is clamped. Fins 125 preferably extend radially outward from a respective axis of rotation of the roller and connect toothed wheel 124 to outer disk 126. Fins 125 typically are positioned behind every other tooth 124*a* on wheel 124. As can be seen in FIGS. 8 and 9, fins on opposing disks typically are offset such that the fins are positioned behind alternating teeth.

Each roller is configured to rotate about an axis of rotation, and move vertically under the power of a respective clamping mechanism Typically, the roller is driven under power transferred through a respective axle. By varying the vertical distance between an opposed pair of rollers, a variety of sizes of logs may be clamped and conveyed by the rollers, as illustrated in FIGS. 6 and 7. Typically, only the toothed wheel 124 touches the log as it is being held by the rollers.

As shown in FIG. 1, after saw blade 104 cuts tapered log 18, infeed guide assembly 24 remains in gripping contact with an infeed section 18*a* of the tapered log and outfeed guide assembly 26 remains in gripping contact with an outfeed section 18*b* of the tapered log. The outfeed section of tapered log then typically is fed to outfeed conveyor 16 for further processing by other machines.

As shown in FIG. 2, log processing apparatus 10 may also include position sensors 130*a*–130*d* configured to sense the position of the log along the travel path. Typically, sensors 130*a*–130*d* are optoelectric sensors attached at intervals along frame assembly 22. Alternatively, virtually any other type of sensor may be used. In addition log processing apparatus 10 may also include a width sensor 132 configured to sense the width of the log. Typically, width sensor 132 is a sensor mounted to piston 138 that is configured to measure the degree to which the log causes arms 136 to separate and piston 138 to extend. Alternatively, virtually any other sensor may be used to sense the width of the log. In addition, a length sensor 134, such as a digital scanner or other device, may be positioned, for example, on infeed conveyor 16.

Figure 11:
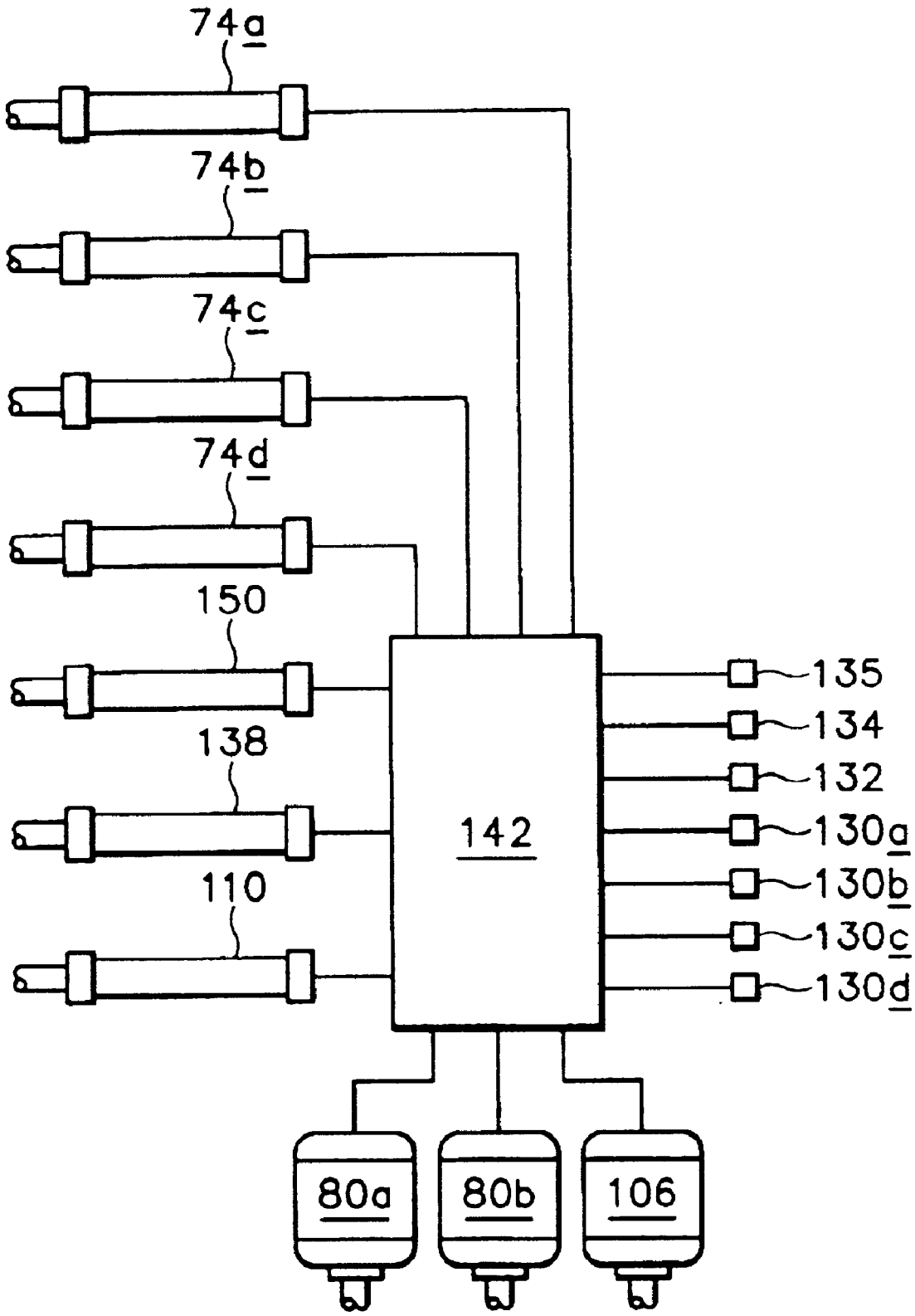
FIG. 11 is a schematic view of electronic components of the present invention

As shown in FIG. 11, controller 142 is coupled to position sensors 130*a*–130*d*, width sensor 132, and length sensor 134 such that it may receive information about the width, length, and current position of the log. The controller may also be linked to a rotation sensor 135 on a roller, such that the controller may compute the position of the log based on the rotation of the roller. In addition, controller 142 may be coupled to motors 80*a* and 80*b*, saw motor 106, piston 110, and air cylinders 74*a*–74*d*. Controller 142 typically is configured to receive information about the position, width, and length of the log from sensors 130*a*–130*b*, 132, and 134, apply a predetermined formula to derive an optimum cutting plan for the log, and instruct motors 80*a* and 80*b* to cause the rollers to rotate and move the log until data from rotation sensor 135 and position sensors 130*a*–130*d* confirm that the log is in a predetermined position for cutting according to the optimum cutting plan. After positioning the log at the predetermined position, controller 142 is configured to instruct the saw motor 106 and piston 110 to rotate saw blade 104 and cut the log.

By advancing and stopping the log with the rollers, the present invention avoids the wear and tear on operators and machinery associated with traditional mechanical stops on log saws. By centering the log between the rollers and cutting the log in a cutting plane perpendicular to the central axis of the log, the present invention avoids wasted time and material and pitting associated with squaring off a log following a nonperpendicular cut. Log saws according to the present invention also decrease the cycle time associated with each cut by moving the saw blade a minimum distance calculated based on the measured width of the log. In addition, cut cycle time is reduced with certain embodiments of the present invention that cut the log while it is in motion, thereby obviating the need for stopping and starting the log at each cut.

While the invention has been disclosed in its preferred form, the specific embodiments thereof as disclosed and illustrated herein are not to be considered in a limiting sense as numerous variations are possible. The subject matter of the invention includes all novel and non-obvious combinations and subcombinations of the various elements, features, functions and/or properties disclosed herein. No single feature, function, element or property of the disclosed embodiments is essential. The following claims define certain combinations and subcombinations which are regarded as novel and non-obvious. Other combinations and subcombinations of features, functions, elements and/or properties may be claimed through amendment of the present claims or presentation of new claims in this or a related application. Such claims are also regarded as included within the subject matter of applicant's invention irrespective of whether they are broader, narrower, or equal in scope to the original claims.

I claim:

1. A log processing apparatus for processing a tapered log, where the tapered log has a central axis, and a region of larger diameter and region of smaller diameter, the log processing apparatus comprising:

a frame assembly; and a roller assembly including:

a pair of upstream rollers positioned respectively above and below a travel path of the tapered log, each upstream roller including a contact region and an axis of rotation, the contact region of each upstream roller being configured to clamp against an opposing side of the tapered log and guide the tapered log along the travel path;

a pair of upstream roller mounts attached to the frame assembly, the pair of upstream roller mounts being configured to support and adjust the axis of rotation of each upstream roller toward and away from the travel path in tandem such that the contact region of each upstream roller remains substantially equidistant from the travel path, wherein intermeshing gear regions link motion of the upstream rollers toward and away from the travel path;

a pair of downstream rollers positioned above and below of the travel path, each downstream roller including a contact region and an axis of rotation, the contact region of each downstream roller being configured to clamp against an opposing side of the tapered log and guide the tapered log along the travel path; and a pair of downstream roller mounts attached to the frame assembly, the pair of downstream roller mounts being configured to adjust the axis of rotation of each downstream roller toward and away from the travel path in tandem such that the contact region of each downstream roller remains substantially equidistant from the travel path, wherein intermeshing gear regions link motion of the downstream rollers toward and away from the travel path;

wherein the pair of upstream rollers and the pair of downstream rollers are configured to adjust independently of each other and clamp the tapered log in respective regions of larger and smaller diameter, thereby supporting the tapered log such that the central axis of the tapered log remains substantially aligned with the travel path.

2. The log processing apparatus of claim 1, further comprising:

a motor mounted to the frame assembly, where at least one of the rollers is operatively coupled to the motor and configured to convey the tapered log along the travel path.

3. The log processing apparatus of claim 2, where each of the pair of upstream rollers is operatively coupled to the motor and configured to convey the tapered log along the travel path.

4. The log processing apparatus of claim 2, where each of the downstream rollers is operatively coupled to the motor and configured to convey the tapered log along the travel path.

5. The log processing apparatus of claim 1, further comprising a controller configured to cause the rollers to cease rotating to stop the log at a predetermined position along the travel path.

6. The log processing apparatus of claim 1, where a one of the rollers includes a toothed wheel configured to rollingly engage the tapered log.

7. The log processing apparatus of claim 6, where the one of the rollers includes a pair opposed inwardly sloping disks configured to center the tapered log relative to the roller, and a second toothed wheel, each toothed wheel being positioned inward and adjacent to a respective one of the disks and being configured to rollingly engage the tapered log.

8. The log processing apparatus of claim 7, where each of the inwardly sloping disks includes a plurality of fins extending radially outward from a respective axis of rotation.

9. The log processing apparatus of claim 1, further comprising:

a saw assembly mounted to the frame assembly adjacent the roller assembly, the saw assembly including a saw blade configured to cut the tapered log and a saw support structure configured to couple the saw blade to the frame assembly and move the saw blade such that the saw blade cuts the tapered log along a cutting plane substantially perpendicular to the central axis of the tapered log.

10. The log processing apparatus of claim 9, where the saw blade is a substantially vertically centered relative to the tapered log as it moves along the cutting path.

11. The log processing apparatus of claim 9, where the saw blade is circular and is configured to cut through the tapered log by traveling less than half the diameter of the saw blade in the direction of the tapered log.

12. The log processing apparatus of claim 9, where the saw support structure is configured to slide horizontally relative to the frame assembly at a rate of speed substantially equal to the log, thereby facilitating cutting of the log by the saw blade while the log is moving along the travel path.

13. The log processing apparatus of claim 1, where the tapered log includes an infeed section and an outfeed section, each section of the tapered log including a respective central axis, the log processing apparatus further comprising:

a tool mounted to the frame assembly, the tool being configured to operate upon the log and including an infeed side and an outfeed side, where the roller assembly is positioned adjacent an infeed side of the tool and configured to feed the tapered log to the tool.

14. The log processing apparatus of claim 13, wherein the pair of upstream rollers is a first pair of upstream rollers, the pair of upstream roller mounts is a first pair of upstream roller mounts, the pair of downstream rollers is a first pair of downstream rollers, and the pair of downstream roller mounts is a first pair of downstream roller mounts, the log processing apparatus further comprising:

an outfeed roller assembly mounted to the frame assembly adjacent an outfeed side of the tool, the outfeed roller assembly including:

a second pair of upstream rollers positioned on opposing sides of the travel path of the outfeed section of the tapered log, each of the second pair of upstream rollers including a contact region and an axis of rotation, the contact region of each of the second pair of upstream rollers being configured to clamp against an opposing side of the outfeed section of the tapered log and guide the outfeed section of the tapered log along the travel path;

a second pair of upstream roller mounts attached to the frame assembly, the second pair of upstream roller mounts being configured to support and adjust the axis of rotation of each of the second pair of upstream rollers toward and away from the travel path in tandem such that the contact region of each of the second pair of upstream rollers remains substantially equidistant from the travel path; and a second pair of downstream rollers positioned on opposing sides of the travel path, each of the second pair of downstream rollers including a contact region and an axis of rotation, the contact region of each of the second pair of downstream rollers being configured to clamp against an opposing side of the outfeed section of the tapered log and guide the outfeed section of the tapered log along the travel path;

a second pair of downstream roller mounts attached to the frame assembly, the second pair of downstream roller mounts being configured to adjust the axis of rotation of each of the second pair of downstream rollers toward and away from the travel path in tandem such that the contact region of each of the second pair of downstream rollers remains substantially equidistant from the travel path;

wherein the second pair of upstream rollers and the second pair of downstream rollers are configured to travel independently from each other and clamp the outfeed section of the tapered log in a respective region of larger or smaller diameter, thereby supporting the outfeed section of the tapered log such that the central axis of the outfeed section of the tapered log remains oriented substantially along the travel path.

15. The log processing apparatus of claim 1, further comprising:

a sensor configured to monitor the position of the tapered log along the travel path, where the roller assembly is configured to adjust the position of the log to a predetermined position based on data from the sensor, thereby enabling the saw blade to cut the log into sections of predetermined lengths.

16. The log processing apparatus of claim 15, where the contact region of at least one of the upstream rollers or downstream rollers is configured to remain in rolling contact with the tapered log, and the one of the upstream or downstream rollers further includes a rotation sensor configured to monitor rotation of the one of the upstream or downstream rollers and displacement of the tapered log along the travel path.

17. The log processing apparatus of claim 15, further comprising:

a position sensor coupled to the frame assembly, the sensor being configured to detect the position of the tapered log along the travel path.

18. A log processing apparatus for centering a log along a travel path, comprising:

a frame assembly;

a pair of rollers disposed above and below the travel path, each roller including a pair of inwardly sloping disks configured to center the log within the roller, and a toothed wheel configured to rollingly engage the log; and a clamping mechanism coupling each of the rollers to the frame assembly, the clamping mechanism being configured to squeeze each of the rollers against the log in tandem such that the position of each roller is substantially equidistant from a central axis of the log, thereby vertically aligning the central axis of the log substantially along the travel path.

19. A log processing apparatus for processing a tapered log, where the tapered log has a central axis, and a region of larger diameter and region of smaller diameter, the log processing apparatus comprising:

a fame assembly; and a guide assembly including:

a pair of upstream guides and a pair of downstream guides, each pair of guides being positioned on opposing sides of a travel path of the tapered log, and each guide including a contact region and a roller including an axis of rotation, the contact region being configured to contact the tapered log and guide the tapered log along the travel path;

a pair of clamping mechanisms, each clamping mechanism coupling a corresponding pair of guides to the frame assembly such that each of the guides is adjustable in a direction substantially perpendicular to both the travel path of the tapered log and the axis of rotation of the rollers each clamping mechanism including intermeshing gear regions configured to link the corresponding pair of guides such that the contact region of each guide remains substantially equidistant from the travel path.

20. A log processing apparatus for gripping a log, comprising:

a frame assembly;

a pair of clamping mechanisms attached to the frame assembly, each clamping mechanism including a pair of rollers, each clamping mechanism being configured to support one of the rollers above a travel path of the log and the other of the rollers below the travel path of the log, such that the rollers may be moved up and down to clamp and center the log vertically along the travel path;

a pair of intermeshing gear regions configured link the motion of the pair of rollers, such that each of the pair rollers remains substantially equidistant from the travel path of the log;

wherein the clamping mechanisms are configured to clamp the log independently of each other and vertically center a respective region of the log along the travel path.

21. A log processing apparatus for gripping a log, comprising:

a frame assembly;

a pair of roller mounts coupled to the frame, the pair of roller mounts being configured to support respective rollers above and below a travel path of the log; and a single hydraulic piston configured to impart clamping motion to both of the roller mounts, to vertically center the log on the travel path.

* * * * *